US006035625A

United States Patent [19]

Schlomer et al.

[11] Patent Number: 6,035,625

[45] Date of Patent: Mar. 14, 2000

[54] YARN WITHDRAWAL NOZZLE

[75] Inventors: Bert Schlomer; Lothar Winzen, both of Heinsberg; Jens Geerligs, Moenchengladbach, all of Germany

[73] Assignee: W. Schlafhorst AG & Co., Moenchenglabach, Germany

[21] Appl. No.: 09/146,623

[22] Filed: Sep. 3, 1998

[30] Foreign Application Priority Data

Sep. 3, 1997 [DE] Germany ..... 197 38 382

[51] Int. Cl.[7] ..... D01H 4/00

[52] U.S. Cl. ..... 57/417; 57/352; 57/414

[58] Field of Search ..... 57/352, 404, 406, 57/407, 408, 411, 413, 417

[56] References Cited

U.S. PATENT DOCUMENTS

| | | | |
|---|---|---|---|
| 4,122,653 | 10/1978 | Argereu | 57/352 |
| 4,610,134 | 9/1986 | Busch et al. | 57/417 |
| 4,665,687 | 5/1987 | Ott et al. | 57/417 |
| 4,702,069 | 10/1987 | Maximov et al. | 57/417 |
| 4,843,812 | 7/1989 | Raasch | 57/417 |
| 5,265,406 | 11/1993 | Hofmann et al. | 57/417 |
| 5,423,177 | 6/1995 | Raasch | 57/417 |

FOREIGN PATENT DOCUMENTS

| | | | |
|---|---|---|---|
| 422615 | 4/1991 | European Pat. Off. | 57/417 |
| 0 422 615 B1 | 12/1994 | European Pat. Off. . | |
| 25 44 721 A1 | 4/1977 | Germany . | |
| 33 44 741 A1 | 6/1985 | Germany . | |
| 37 07 526 A1 | 9/1988 | Germany . | |
| 42 24 632 A1 | 1/1994 | Germany . | |
| 51-130829 | 10/1976 | Japan . | |
| 2-6636 | 1/1990 | Japan | 57/417 |
| 503 127 | 3/1971 | Switzerland . | |
| 2182069 | 5/1987 | United Kingdom | 57/417 |

*Primary Examiner*—William Stryjewski
*Attorney, Agent, or Firm*—Kennedy Covington Lobdell & Hickman, LLP

[57] ABSTRACT

A yarn withdrawal nozzle (20) for an open-end rotor spinning device (1) has a yarn inlet zone (29) tapering in a funnel-like manner into a yarn withdrawal conduit (21), with the yarn inlet zone being formed with both a spiral structure (30) as well as additional notches (34) in the inlet area of the yarn withdrawal conduit (21). As viewed in the yarn withdrawal direction (A), the notches (34) are either arranged following the spiral structure (30) or at least partially in the area of the spiral structure (30).

8 Claims, 2 Drawing Sheets

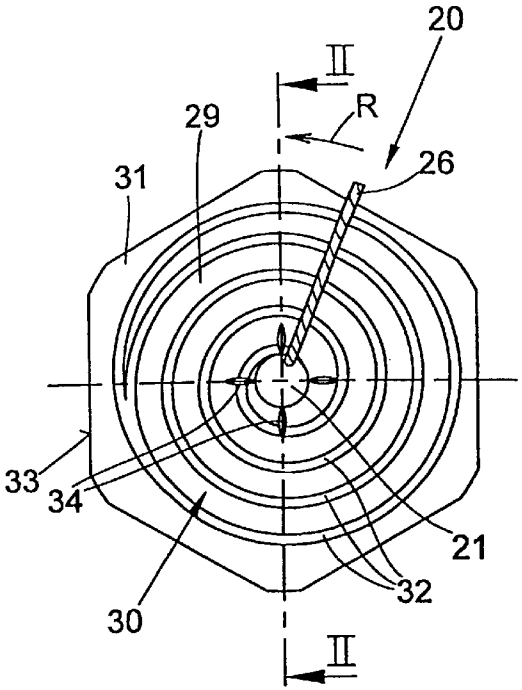
FIG. 3
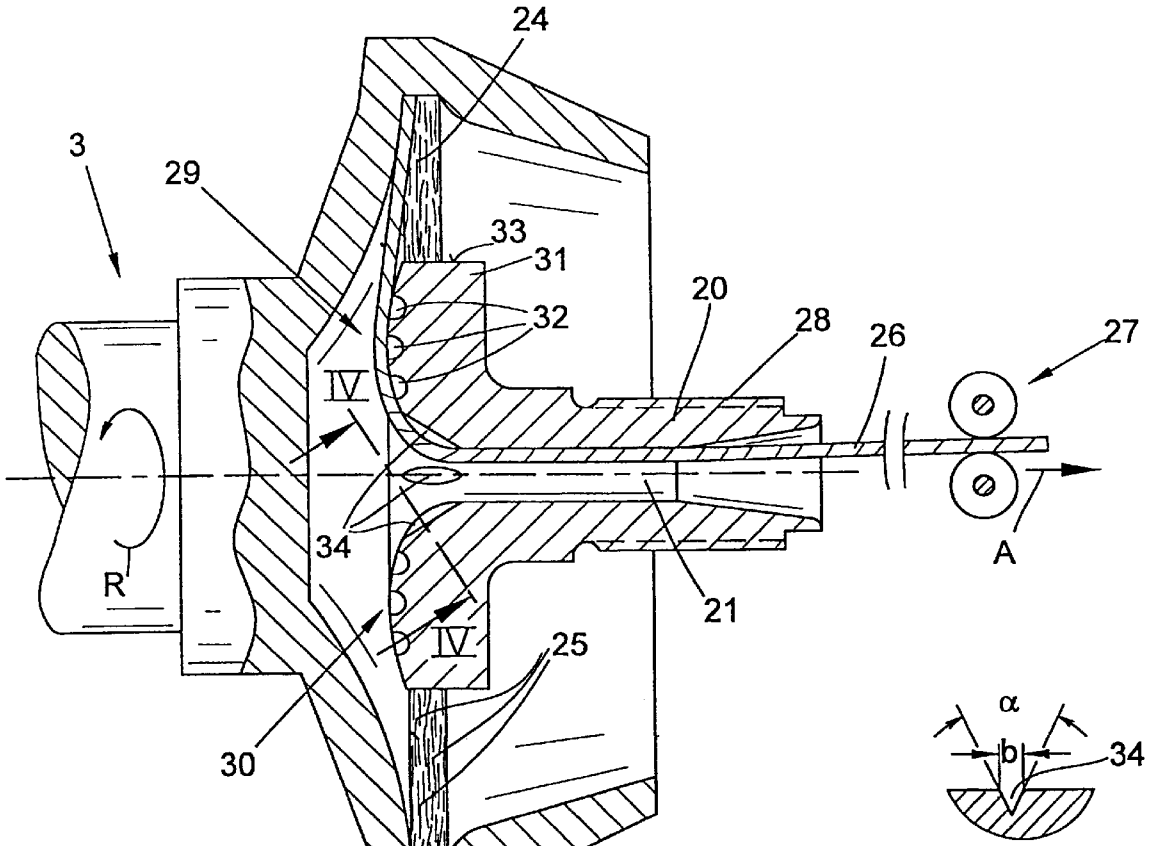
FIG. 4
FIG. 2

YARN WITHDRAWAL NOZZLE

FIELD OF THE INVENTION

The present invention relates to a yarn withdrawal nozzle for an open-end rotor spinning device, having a spiral structure in the yarn contact area of the yarn withdrawal nozzle.

BACKGROUND OF THE INVENTION

Yarn withdrawal nozzles for open-end rotor spinning devices are known in various embodiments.

There is a well-known problem in connection with open-end spinning devices, in that the real yarn twist initiated by the rotation of the spinning rotor does not continue evenly into the yarn end being created, that is, the real yarn twist is applied in an intensified manner to the extent of yarn which is located between the yarn withdrawal nozzle and the yarn withdrawal device of the open-end rotor spinning device. However, the real yarn twist often continues quite incompletely into the yarn extent located upstream of the yarn withdrawal nozzle.

Since too low a yarn twist in the yarn extent located between the fiber collection groove and the yarn withdrawal nozzle has an extremely negative effect on the spinning stability of an open-end rotor spinning device, yarn withdrawal nozzles which are provided with a special surface structure, preferably roughened, have already been developed in the past. Such rough surface structures are intended to increase the friction between the withdrawal nozzle surface and the rotating yarn, and thereby to apply a false twist in addition to the real yarn twist to the yarn extent being created. Since the false twist being created extends into the yarn extent located between the fiber collection groove and the yarn withdrawal nozzle, such a surface structure of the yarn withdrawal nozzle leads to an improvement of the spinning stability of the open-end spinning device.

Different embodiments are known in regard to the surface structure of yarn withdrawal nozzles. German Patent Publications DE-OS 25 44 721 and DE 33 44 741 A1 or European Patent Publication EP 0 422 615 B1, for example, describe yarn withdrawal nozzles having notch-like depressions in the area of the yarn inlet zone.

In accordance with DE-OS 25 44 721, the yarn withdrawal nozzle is made of an oxide-ceramic material and has a peak-to-valley height of 0.2 to 0.7 Tm in the area of the yarn inlet funnel. Notches, which can have various notch opening angles, are furthermore arranged in the area of the yarn inlet funnel.

The yarn withdrawal nozzles described in DE 33 44 741 A1 have an exchangeable yarn inlet funnel, which has been drawn from sheet steel and subsequently hardened. Here, the yarn inlet funnel either has notches or protruding beads. It is furthermore known from this patent to position notches in two ring-shaped arrangements located one behind the other in the direction of yarn travel.

EP 0 422 615 B1 relates to a yarn withdrawal nozzle which has notches in the area of the yarn inlet zone and protrusions in the area of the yarn withdrawal conduit. Here, the notches are intended to improve the spinning stability of the open-end spinning device, while the protrusions in the yarn withdrawal conduit are used to produce an especially napped yarn.

Although it has been possible by means of the above described yarn withdrawal nozzles, known as "notched nozzles", to increase the spinning stability of the open-end spinning devices, the improvement of spinning stability occurred, at least in part, at the expense of the yarn quality which could be achieved.

In connection with yarn withdrawal nozzles for open-end spinning devices it has furthermore been long known to arrange a spiral structure in the area of the yarn inlet zone in place of notches. Swiss Patent 503 127, German Patent Publications DE 37 07 256 A1 and DE 42 24 632 A1, Japanese Utility Model Sho 51-130 829 or European Patent Publication EP 0 220 546 A1 relate to yarn withdrawal nozzles designed in this manner.

In such yarn withdrawal nozzles, the spiral structure can be embodied as a strip-shaped raised part or as a groove-shaped depression, as explained in German DE 37 07 526 A1 and Swiss Patent 503 127, and preferably extends over the entire yarn inlet zone of the yarn withdrawal nozzle up to the start of the yarn withdrawal conduit.

Japanese Utility Model Sho 51-130 829 discloses different variations of yarn withdrawal nozzles with a spiral surface structure. In connection with one of the embodiments represented, the spiral structure extends past the area of the yarn inlet zone and into the yarn withdrawal conduit.

An open-end spinning device with a yarn withdrawal nozzle with a spiral bead in the area of the yarn inlet zone is described in European Patent Publication EP 0 220 546 A1. A tube with beads lying obliquely in respect to the yarn traveling direction is connected downstream of the yarn withdrawal nozzle.

A comparable yarn withdrawal nozzle with a spiral structure is also described in German DE 42 24 632 A1. This known "spiral nozzle" has surfaces which extend in the manner of a spiral and are linear in respect to the yarn traveling direction. To obtain yarn reversing points, the surfaces have been inclined at an angle in respect to each other.

With such an embodiment, the yarn is supported over relatively large areas on the surfaces which are linear in respect to the yarn traveling direction, and in this way the surface pressure acting on the yarn is reduced to a permissible amount. Furthermore, by means of the yarn transition points formed between the linear surfaces at an angle to each other, thrust components are transferred to the yarn which act to keep the yarn twist in the area between the fiber collection groove and the yarn withdrawal nozzle at a higher value.

As a rule, with the above described yarn withdrawal nozzles, known as "spiral nozzles", the yarn slides over raised parts of the spiral structure in the course of being withdrawn. In this case the orientation of the spiral structure is such that a thrust component at the yarn extent being created in the direction toward the fiber collection groove becomes effective with an appropriate rotation direction of the yarn. This thrust component has the effect that the real yarn twist introduced between the fiber collection groove and the yarn withdrawal nozzle is at least partially prevented from leaving this area.

In contrast to withdrawal nozzles with a smooth surface, it is possible by means of such "spiral nozzles" to introduce a higher twist into the yarn extent ahead of the yarn withdrawal nozzle, and in this manner to lower the number of occurring yarn breaks. Although as a rule "spiral nozzles" achieve better yarn qualities in comparison with the so-called "notched nozzles", they have the disadvantage that the spinning stability which can be achieved is often unsatisfactory.

SUMMARY OF THE INVENTION

In light of the above mentioned state of the art, it is an object of the invention to improve the known yarn withdrawal nozzles.

In accordance with the invention, this object is attained by means of a yarn withdrawal nozzle for an open-end rotor spinning device which basically comprises an annular yarn contact area, a spiral structure formed about the yarn contact area, and notches formed in the yarn contact area.

This combination of a spiral structure as well as notches in the area of the funnel-like yarn inlet zone of the yarn withdrawal nozzle of the present invention is not only distinguished by good spinning stability but it is also possible by means of such yarn withdrawal nozzles to achieve yarn qualities which are clearly improved in important areas in comparison with the yarn qualities achieved by known yarn withdrawal nozzles.

Thus, with the yarn withdrawal nozzle of the present invention, at least a part of the measurable yarn qualities, in particular with respect to variations of the yarn strength and the yarn stretch, is considerably improved over the corresponding yarn qualities of known yarn withdrawal nozzles.

In an advantageous manner, the yarn contact area comprises a tapering yarn inlet area shaped in the form of a funnel, with the spiral structure being arranged in the tapering inlet area and the notches being at least partially arranged within the area of the spiral structure or, alternatively, with the notches arranged to follow the spiral structure in the direction of yarn withdrawal along the yam contact area.

In both cases, the combination of a spiral structure and nozzles results in yarn withdrawal nozzles which are eminently suited for the production of knitting yams with a reduced twist factor, which can take place on a very high rotor rpm level.

The spiral structure may be advantageously embodied as one or more spiral grooves. In respect to comparable spiral strips, which are also conceivable, the cutting of spiral grooves has the advantage of preventing that the new yarn, which is still relatively sensitive, is immediately exposed to a possibly impermissibly high surface pressure in this area.

The yarn qualities which can be achieved are particularly good if each of the notches of the yarn withdrawal nozzle are arranged and/or designed in a V shape defining a notch angle of approximately 45° and a notch width between about 0.2 and 0.5 mm.

Further details and features of the invention will be understood by the following description of an exemplary embodiment with reference to the accompanying drawings.

BRIEF DESCRIPTION OF THE DRAWINGS

FIG. 2 is an axial cross-sectional view of a yarn withdrawal nozzle in accordance with the present invention, depicted in its operational disposition inside a spinning rotor, taken along the line II—II in FIG. 3, FIG. 3 is a front end elevational view of a yarn withdrawal nozzle of the present invention, and FIG. 4 is an enlarged cross-sectional view of one of the notches of the present invention taken along the line IV—IV in FIG. 2.

DETAILED DESCRIPTION OF THE PREFERRED EMBODIMENT

Figure 1:
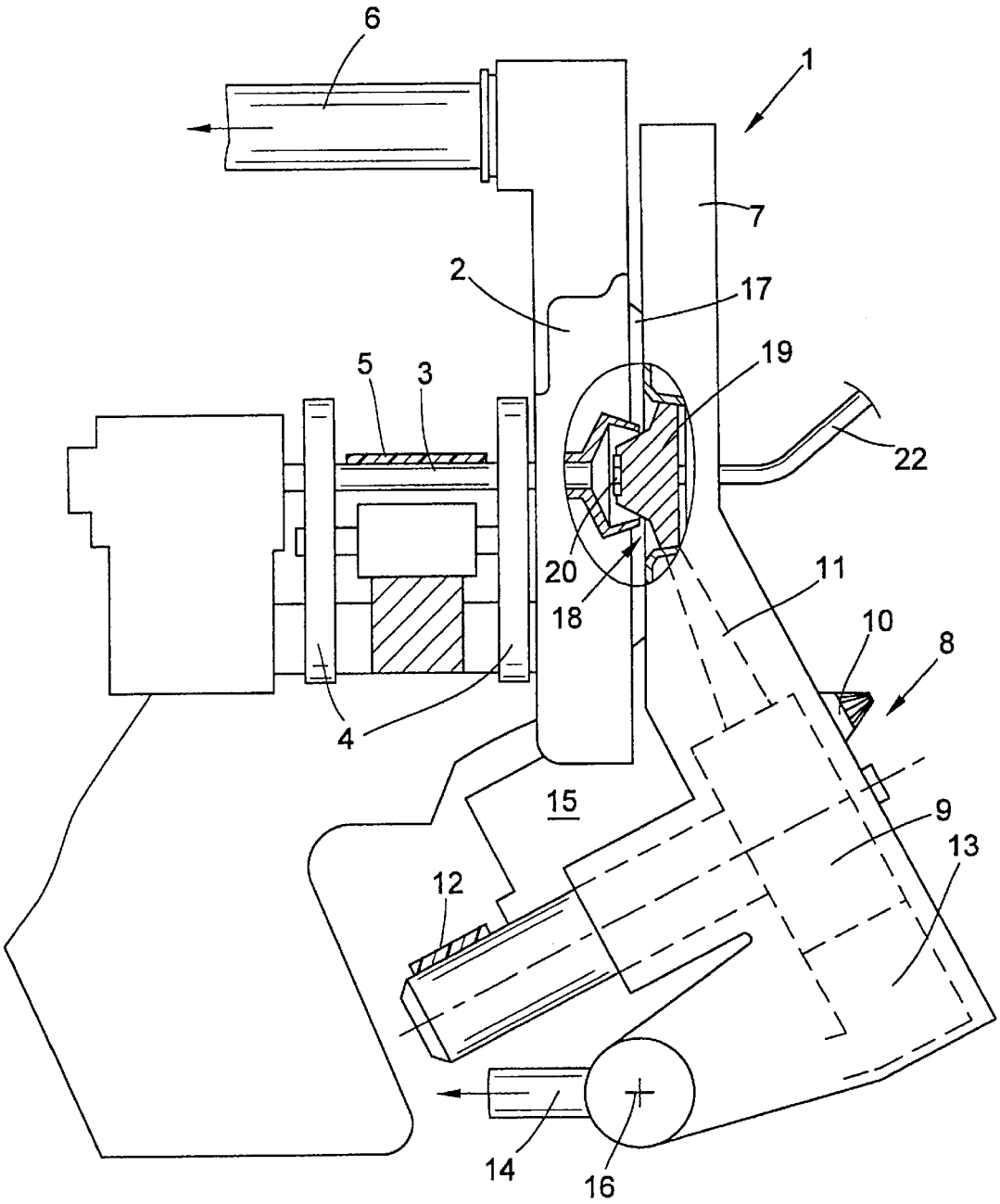
FIG. 1 is a schematic side elevational view, partially in section, of an open-end spinning device.

Referring now to the accompanying drawings and initially to FIG. 1, an open-end spinning device 1 is shown having a known rotor housing 2 in which a spinning rotor 3 rotates at high speed. The spinning rotor 3 is supported on a support disk bearing 4 and is driven by means of a tangential belt 5.

The rotor housing 2 is connected to an aspirating device 6 and is covered during operation by a cover element 7, which is pivotably seated around a pivot shaft 16. The cover element 7 carries a sliver opening device 8 with an opening roller 9, a sliver intake roller 10 (not shown in greater detail) and a fiber guide conduit 11. During the spinning process the cover element 7 closes the rotor housing 2, which otherwise would be open, by means of a sealing element 17. Customarily, the opening roller 9 is driven by a tangential belt 12, while the driving of the sliver intake roller 10 is accomplished either by means of a driveshaft extending over the length of the machine or, as indicated in FIG. 1, by an individual electric motor drive 15.

In addition, a debris collection chamber 13 is located underneath the opening roller 9 in the cover element 7, which is continuously emptied by means of a dirt aspirating device 14.

A so-called conduit plate adapter 15 is fixed in place in a receptacle 18 of the cover element 7 which contains, among other things, the opening area (not represented) of the fiber guide conduit 11. The yarn withdrawal nozzle 20 of the present invention is also arranged in the conduit plate adapter 19 and defines a yarn withdrawal conduit 21 extending therethrough along the longitudinal center axis of the nozzle and terminating into a smaller yarn withdrawal tube 22.

As indicated in an enlarged scale in FIG. 2, during the spinning process the yarn withdrawal nozzle 20 is positioned inside the spinning cup 23 of the spinning rotor 3, which cup is open toward the front side of the spinning rotor 3. The spinning cup 23 has a peripheral fiber collection groove 24 and rotates at high speed in the direction R, as already indicated at the outset.

In the manner customary in connection with open-end rotor spinning devices, the individual fibers 25 fed into the spinning cup through the fiber guide conduit 11 are initially collected in the area of the fiber collection groove 24 and thereafter withdrawn in the form of a yarn 26 by means of the yarn withdrawal nozzle 20. The yarn withdrawal speed, with which the new yarn 26 leaves the open-end spinning device 1 in the direction A, is a function of different factors, such as the rotor rpm, the yarn twist, etc., and can be set by means of a yarn withdrawal device 27.

The yarn withdrawal nozzle 20 is releasably fixed in place in the conduit plate adapter 19, for example by means of an exterior thread 28 or a magnetic connection (not represented), and has a spiral structure 30 in the area of its yarn inlet zone 29. This spiral structure 30 is preferably formed by one or several spiral grooves 32, which extend from the area of the outer edge 33 of the nozzle head 31 to the start of the yarn withdrawal conduit 21.

It is to be understood that the exact embodiment of the spiral groove 32 is not limited to the exemplary embodiment represented. However, taking into consideration the direction of rotation of the yarn 26, the direction of turning of the spiral structure 30 should, as is known per se, be selected such that the spiral groove 32 performs the function of a conveyor worm, that is, the yarn 26 should be acted upon by the spiral groove 32 such that a thrust component acts on the yarn 26 in the direction toward the fiber collection groove 24, i.e. opposite the yarn withdrawal direction A.

In the yarn inlet zone 29 the yarn withdrawal nozzle 20 of the invention has several notches 34 in addition to the spiral structure 30. While four notches 34 are represented in the present exemplary embodiment, it will be understood that a greater or lesser number of such notches may be provided. The notches 34 are located in the funnel-like inlet area of the yarn withdrawal conduit 21 of the yarn withdrawal nozzle 20. More specifically, as viewed in the yarn traveling direction A, the notches 34 can be arranged slightly behind the spiral structure 30 or, as indicated in the exemplary embodiment, the notches 34 can at least partially extend into the area of the spiral structure 30.

As the sectional representation in FIG. 4 shows, the notches 34 are preferably embodied in a V shape and have a notch angle I of approximately 45°. The width b of the notches 34 here lies between about 0.2 and 0.5 mm.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn withdrawal nozzle for an open-end rotor spinning device, the yarn withdrawal nozzle comprising an annular yarn contact area including a tapering yarn inlet area shaped in the form of a funnel, a spiral structure formed about the yarn contact area, and notches formed in the tapering inlet area of the yarn contact area.

2. The yarn withdrawal nozzle in accordance with claim 1, wherein the notches are arranged to follow the spiral structure in the direction of yarn withdrawal along the yarn contact area.

3. The yarn withdrawal nozzle in accordance with claim 1, wherein the notches are at least partially arranged within the area of the spiral structure.

4. The yarn withdrawal nozzle in accordance with claim 1, wherein the spiral structure comprises a spiral groove formed in the yarn contact area.

5. The yarn withdrawal nozzle in accordance with claim 1, wherein each notch is in a V shape defining a notch angle of approximately 45°.

6. The yarn withdrawal nozzle in accordance with claim 1, wherein each notch has a width between about 0.2 and about 0.5 mm.

7. A yarn withdrawal nozzle for an open-end rotor spinning device, the yarn withdrawal nozzle comprising an annular yarn contact area, a spiral structure formed about the yarn contact area, and notches formed in the yarn contact area, each notch being in a V shape defining a notch angle of approximately 45°.

8. A yarn withdrawal nozzle for an open-end rotor spinning device, the yarn withdrawal nozzle comprising an annular yarn contact area, a spiral structure formed about the yarn contact area, and notches formed in the yarn contact area, each notch having a width between about 0.2 and about 0.5 mm.

* * * * *